US007218501B2

(12) United States Patent
Keely

(10) Patent No.: US 7,218,501 B2
(45) Date of Patent: May 15, 2007

(54) HIGH EFFICIENCY POWER SUPPLY CIRCUIT FOR AN ELECTRICAL DISCHARGE WEAPON

(75) Inventor: William Arthur Keely, Oxford, MI (US)

(73) Assignee: Defense Technology Corporation of America, Casper, WY (US)

( * ) Notice: Subject to any disclaimer, the term of this patent is extended or adjusted under 35 U.S.C. 154(b) by 85 days.

(21) Appl. No.: 11/165,267

(22) Filed: Jun. 22, 2005

(65) Prior Publication Data

US 2007/0019357 A1 Jan. 25, 2007

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS

| | | | | |
|---|---|---|---|---|
| 689,547 | A | | 12/1901 | James |
| 1,045,800 | A | | 11/1912 | Lewis |
| 1,338,239 | A | | 4/1920 | Matys |
| 1,535,459 | A | | 4/1925 | Fredrickson |
| 2,093,514 | A | | 9/1937 | Cornett et al. |
| 2,977,580 | A | | 3/1961 | Sprecher |
| 3,374,708 | A | | 3/1968 | Wall |
| 3,523,538 | A | | 8/1970 | Shimizu |
| 3,803,463 | A | | 4/1974 | Cover |
| 4,202,031 | A | * | 5/1980 | Hesler et al. ..... 363/97 |
| 4,253,132 | A | | 2/1981 | Cover |
| 4,541,191 | A | | 9/1985 | Morris et al. |
| 4,688,140 | A | | 8/1987 | Hammes |
| 4,716,509 | A | * | 12/1987 | Roccucci ..... 363/26 |
| 4,777,754 | A | | 10/1988 | Reynolds, Jr. |
| 4,872,084 | A | | 10/1989 | Dunning et al. |
| 4,982,645 | A | | 1/1991 | Abboud |
| 5,012,606 | A | | 5/1991 | McNulty, Jr. |
| 5,078,117 | A | | 1/1992 | Cover |
| 5,193,048 | A | | 3/1993 | Kaufman et al. |
| 5,220,115 | A | | 6/1993 | Wales et al. |
| 5,243,894 | A | | 9/1993 | Minovitch |
| 5,473,501 | A | | 12/1995 | Claypool |
| 5,625,525 | A | | 4/1997 | Coakley et al. |
| 5,654,867 | A | | 8/1997 | Murray |
| 5,671,559 | A | | 9/1997 | Ludaesher et al. |
| 5,675,103 | A | | 10/1997 | Herr |
| 5,698,815 | A | | 12/1997 | Ragner |
| 5,758,448 | A | | 6/1998 | Thummel |

(Continued)

OTHER PUBLICATIONS

*Less-Lethal Update: Cutting Edge Technology, Part 1*, Police and Security News, Days Communications, Inc., vol. 20, Issue 3, May/Jun. 2004, 3 pages.

(Continued)

*Primary Examiner*—Ronald W. Leja
(74) *Attorney, Agent, or Firm*—Christie, Parker & Hale, LLP.

(57) ABSTRACT

An electrical discharge weapon for immobilizing a live target that includes a shock circuit having a low power consumption, a high power efficiency, and/or a low weight. The shock circuit may be entirely contained in a projectile without the need for range limiting trailing wires. In one embodiment, the shock circuit includes a high efficiency circuit that recaptures an certain amount of energy that would otherwise be wasted.

22 Claims, 13 Drawing Sheets

U.S. PATENT DOCUMENTS

| | | | |
|---|---|---|---|
| 5,786,546 | A | 7/1998 | Simson |
| 5,787,628 | A | 8/1998 | Teetzel |
| 5,822,905 | A | 10/1998 | Teetzel |
| 5,831,199 | A | 11/1998 | McNulty, Jr. et al. |
| 5,841,622 | A | 11/1998 | McNulty, Jr. |
| 5,936,183 | A | 8/1999 | McNulty, Sr. |
| 5,955,695 | A | 9/1999 | McNulty, Sr. |
| 5,962,806 | A | 10/1999 | Coakley et al. |
| 5,983,548 | A | 11/1999 | Ludaescher |
| 6,022,120 | A | 2/2000 | Chang |
| 6,053,088 | A | 4/2000 | McNulty, Jr. |
| 6,256,916 | B1 | 7/2001 | McNulty |
| 6,269,726 | B1 | 8/2001 | McNulty, Sr. |
| 6,360,645 | B1 | 3/2002 | McNulty, Jr. et al. |
| 6,393,752 | B1 | 5/2002 | Oliver et al. |
| 6,477,933 | B1 | 11/2002 | McNulty, Jr. et al. |
| 6,575,073 | B2 | 6/2003 | McNulty, Jr. et al. |
| 6,636,412 | B2 | 10/2003 | Smith |

OTHER PUBLICATIONS

*M26 Less-Lethal EMD Weapon and M26A Duel Less-Lethal/Lethal Integrated M16 Platform Weapon*, Presented at NDIA Non-Lethal Defense IV, Mar. 20-23, 2000, 25 pages.

Taser International; Homeland Security and Defense Opportunities Conference, Mar. 30, 2004; 24 pages.

* cited by examiner

HIGH EFFICIENCY POWER SUPPLY CIRCUIT FOR AN ELECTRICAL DISCHARGE WEAPON

FIELD OF THE INVENTION

The present invention relates generally to the field of an electrical discharge weapon for immobilizing a live target. More specifically, the present invention is related to an electrical discharge weapon having an improved shock circuit and a method for driving the same.

BACKGROUND OF THE INVENTION

Electrical discharge weapons are weapons that connect a shocking power to a remote live target by means of darts and/or trailing wires fired from the electrical discharge weapons. The shocks debilitate violent suspects, so peace officers can more easily subdue and capture them. Stun guns, by contrast, connect the shocking power to the live target that are brought into direct contact with the stun guns to subdue the target. Electrical discharge weapons are far less lethal than other more conventional firearms.

In general, the basic idea of the above described electrical discharge weapons is to disrupt the electric communication system of muscle cells in a live target. That is, an electrical discharge weapon generates a high-voltage, low-amperage electrical charge. When the charge passes into the live target's body, it is combined with the electrical signals from the brain of the live target. The brain's original signals are mixed in with random noise, making it very difficult for the muscle cells to decipher the original signals. As such, the live target is stunned or temporarily paralyzed. The current of the charge may be generated with a pulse frequency that mimics a live target's own electrical signal to further stun or paralyze the live target.

To dump this high-voltage, low-amperage electrical charge, the electrical discharge weapon includes a shock circuit having multiple transformers and/or autoformers that boost the voltage in the circuit and/or reduce the amperage. The shock circuit may also include an oscillator to produce a specific pulse pattern of electricity and/or frequency. In one embodiment, the charge is then released to the live target via a charge electrode and a ground electrode respectively positioned on a charge dart and a ground dart that are both connected to the weapon by long conductive wires. In the embodiment, the long conductive wires are considered necessary to maintain low force factors necessary for a weapon delivery system which is presumed incapable of seriously injuring a human target, but which is also capable of propelling a projectile at a target for a practical range. That is, it is desirable to use a small propellant charge and a light weight projectile.

However, a disadvantage to such a design of using two wired darts is that both minimum and maximum range are sacrificed. That is, as known to those skilled in the art, depending on the angle between the weapon's bores, the charge and ground darts will not spread enough at closer ranges to insure an adequately large current path through the target, unless the marksman is lucky enough to impact a particularly sensitive area of the body. At further ranges the darts will have spread too far apart for both of them to impact the target as needed to complete the current path through the target. In addition, the wired darts could not pass down the bore of most conventional firearms.

Moreover, if the wires are not deployed to their maximum range and length, they will hang from the cartridge over the bottom of the port or firing bay and frequently rest laxly on the ground in close proximity to each other or even resting upon or overlapping each other for portions of their lengths. Accordingly, the wires have to be insulated by heavy insulation to prevent them from being shorted with each other. The weight of the insulation further limits the range of the darts and the type of firearms that can project these darts.

In view of the foregoing, it would be highly desirable to create a weapon for immobilization and capture of a live target having a shock circuit that can be entirely located within a projectile or a missile of the weapon so that trailing wires can be eliminated while still allowing the weapon to provide a sufficient stun (shock) power. Also, it would be desirable to provide a shock circuit for an electrical discharge weapon that recaptures some of the wasted energy that appears in the total pulse pattern of a charge (e.g., to recapture the part of the energy of a conventional pulse pattern that does not have sufficient amplitude to cause a debilitating shock).

SUMMARY OF THE INVENTION

The present invention relates to a system and/or an associated method for providing an electrical discharge weapon with a shock circuit having a low power consumption, a high power efficiency, and/or a low weight. The shock circuit may be entirely contained in a projectile of the weapon without the need for range limiting trailing wires. In one embodiment, the shock circuit includes a high efficiency circuit that recaptures a certain amount of energy that would otherwise be wasted.

In one exemplary embodiment of the present invention, an electrical shock circuit for an electrical discharge weapon includes a battery source, an inverter transformer, an oscillation capacitor, an independent oscillator, a switch, and a full wave rectifier. The inverter transformer has a primary coil of the inverter transformer connected between a first pad and a second pad and a secondary coil of the inverter transformer connected between a third pad and a fourth pad. The oscillation capacitor is connected between first pad and the second pad. The switch is connected between the inverter transformer and a common voltage node (or a ground.) The switch is also connected to the independent oscillator. The full wave rectifier is connected with the second coil of the inverter transformer via the third pad and the fourth pad. In the present embodiment, the independent oscillator triggers the switch to supply an energy from the battery source to the primary coil of the inverter transformer. The primary coil of the inverter transformer oscillates the energy with the oscillation capacitor at a resonate frequency for a full cycle of the energy. The full cycle of the energy has first and second half cycles, and the first and second half cycles have substantially the same amplitude.

In one exemplary embodiment of the present invention, a method of immobilizing a live target through electricity is provided. The method includes: oscillating an independently controlled waveform from a positive voltage to a ground voltage; driving a transistor via the independently controlled waveform to turn ON and OFF; energizing an initial energy from a battery source through a primary coil of an inverter transformer only when the transistor is turned ON by the independently controlled waveform; resonating a residual energy with a capacitor connected in parallel with the primary coil of the inverter transformer as a magnetic field initially generated by the initial energy flow from the power source collapses; coupling the initial energy and the resonated residual energy from the primary coil of the inverter transformer to a secondary coil of the inverter transformer; and rectifying an initial voltage and current of the initial energy and then a resonant voltage and current of the resonated residual energy in a full-wave manner.

A more complete understanding of the high efficiency power supply circuit will be afforded to those skilled in the art and by a consideration of the following detailed description. Reference will be made to the appended sheets of drawings which will first be described briefly.

BRIEF DESCRIPTION OF THE DRAWINGS

These and other features and aspects of the present invention will be more fully understood when considered with respect to the following detailed description, appended claims, and accompanying drawings.

DETAILED DESCRIPTION OF THE INVENTION

Figure 1:
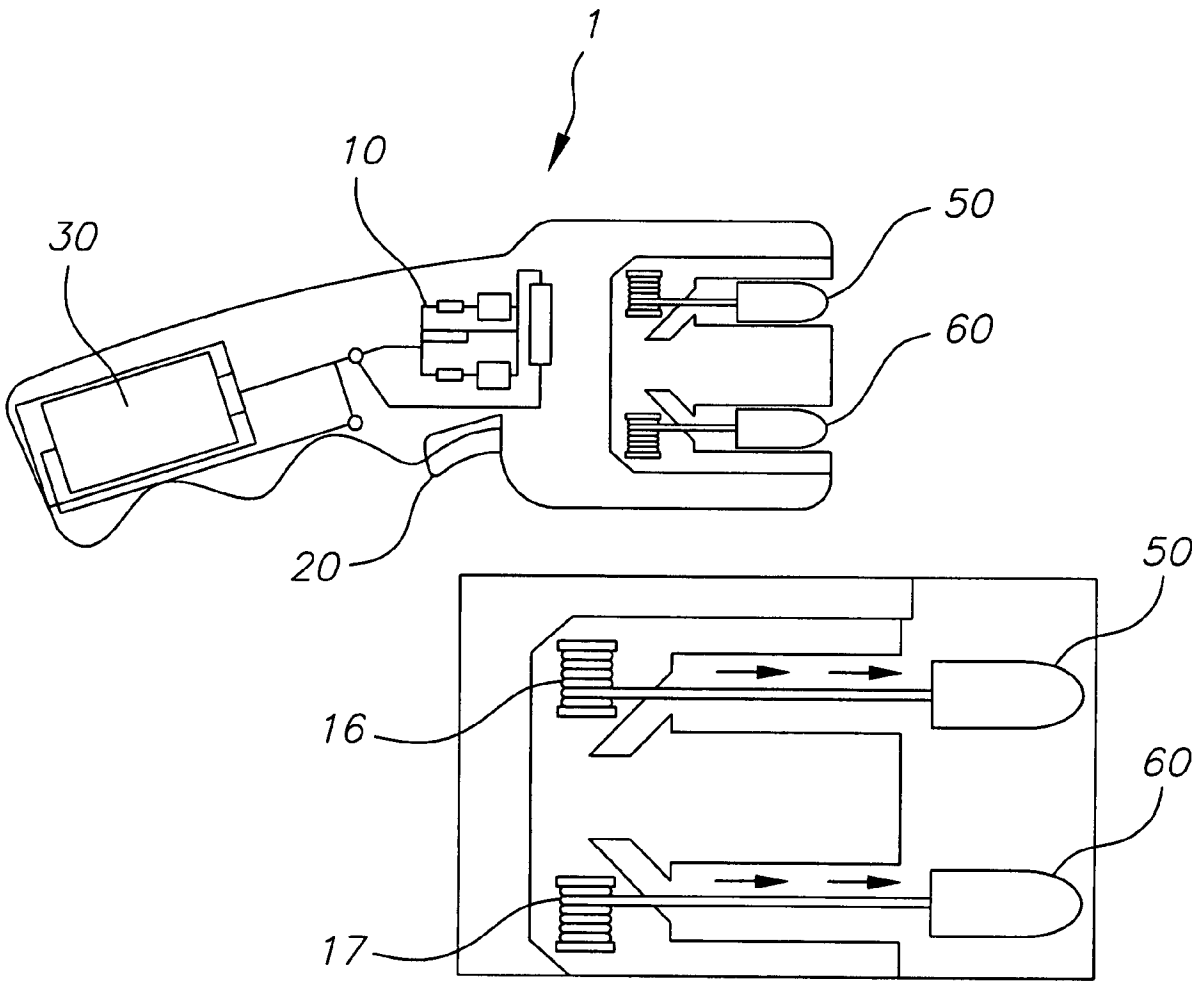
FIG. 1 illustrates an exemplary electrical discharge weapon.

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

There may be parts shown in the drawings, or parts not shown in the drawings, that are not discussed in the specification as they are not essential to a complete understanding of the invention. Like reference numerals designate like elements.

Referring to FIG. 1, an example of an electrical discharge weapon is shown which includes a housing 1, a shock circuit 10, a trigger 20, battery or batteries 30, a first electrically conductive dart 50, and a second electrically conductive dart 60. Each of the darts 50, 60 is connected to the housing by elongate first and second electrically conductive wires 16, 17. The wires 16, 17 are coiled in the housing 1 and unwind and straighten as the darts 50, 60 travel through the air toward a target. The length of wires 16, 17 can vary but the increasing distance of the spread between them limits range (typically about six to nine meters or twenty to thirty feet)

In operation, an electrical charge which travels into the wire 16 and the dart 50 is activated by squeezing the trigger 20. The power for the electrical charge is provided by the battery 30. That is, when the trigger 20 is turned on, it allows the power to travel to the shock circuit 10. The shock circuit 10 includes a first transformer that receives electricity from the battery 30 and causes a predetermined amount of voltage to be transmitted to and stored in a storage capacitor (e.g., a Mylar cap). Once the storage capacitor stores the predetermined amount of voltage, it is able to discharge an electrical pulse into a second transformer and/or autoformer. The output from second transformer then goes into the first wire 16 and the dart 50. The darts 50, 60 are also projected through the air to the target by the squeeze of the trigger 20. When the darts 50, 60 contact the target, charges from the dart 50 travel into tissue in the target's body, then through the tissue into the second dart 60 and the second conducting wire 17, and then to a ground in the housing 1. Pulses are delivered from the dart 50 into target's tissue for a predetermined amount of seconds. The pulses cause contraction of skeletal muscles and make the muscles inoperable, thereby preventing use of the muscles in locomotion of the target.

Figure 2:
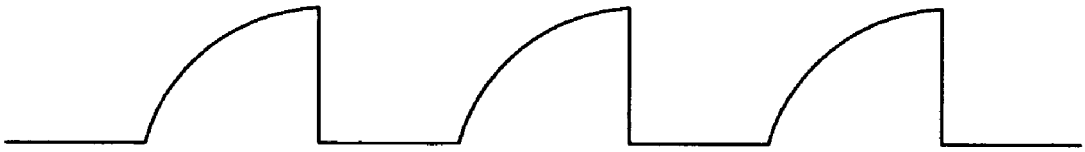
FIG. 2 illustrates a driving waveform of a relaxation oscillator.

Typically, the shocks from an electrical discharge weapon are generated by a classic relaxation oscillator that produces distorted saw tooth pulses as is shown in FIG. 2. A shock circuit having a relaxation oscillator is shown as FIG. 3.

Figure 3:
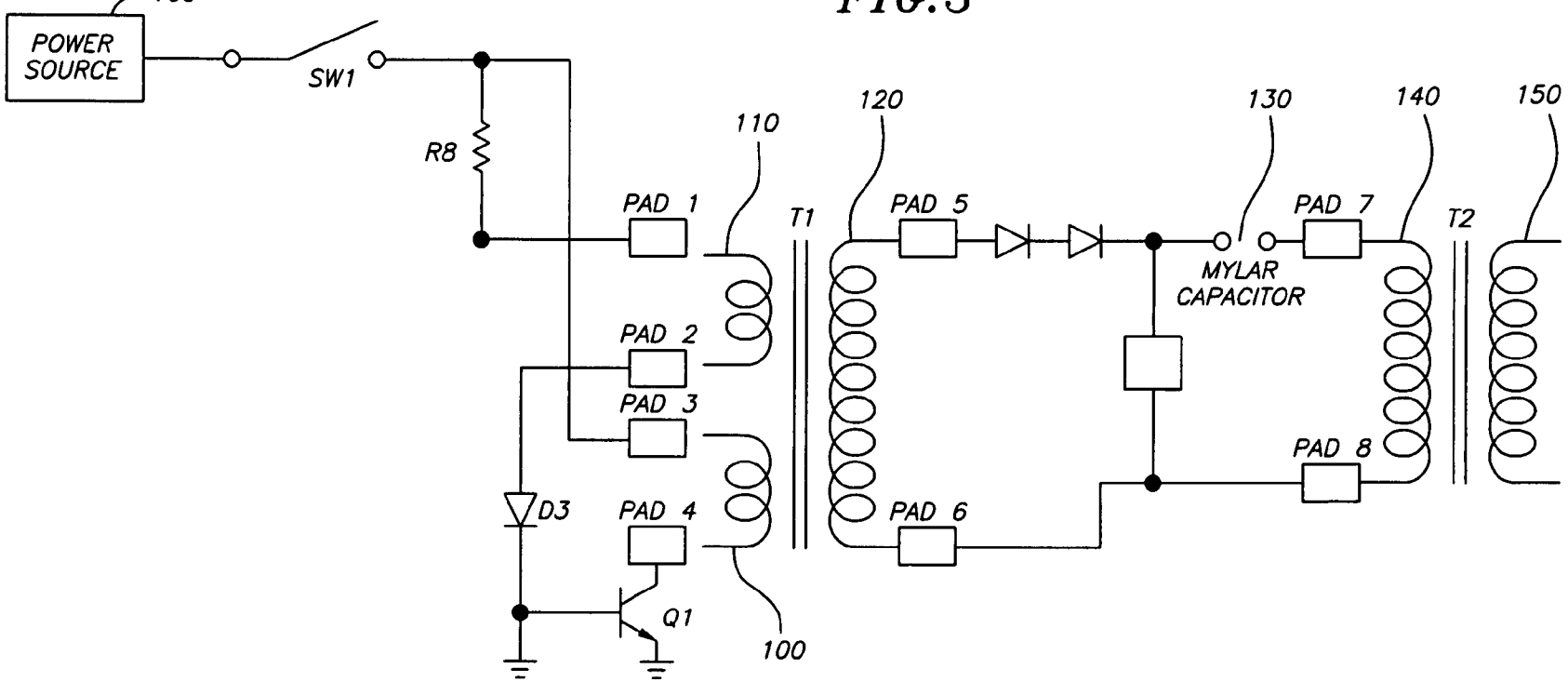
FIG. 3 illustrates a shock circuit using a relaxation oscillator.

Referring to FIG. 3, power is supplied to the shock circuit from a battery source 160. The closure of a switch SWI (e.g., the trigger 20 of FIG. 1) connects the battery source 160 with an inverter transformer TI. In FIG. 3, a tickler coil 110 of the inverter transformer T1 between PAD1 and PAD2 is used to form the classic relaxation oscillator. A primary coil 100 of the inverter transformer T1 is connected between PAD3 and PAD4. Upon closure of the power switch SW1, the primary coil 100 of the inverter transformer T1 is energized as a current flows through the coil 100 from PAD3 to PAD4 as the power transistor Q1 is turned ON. The tickler coil 110 of the inverter transformer T1 is energized upon closure of the power switch SW1 through a resistor R8 and a diode D3. The current through the tickler coil 110 also forms the base current of the power transistor Q1, thus causing it to turn ON. Since the tickler coil 110 and the primary coil 100 of the inverter transformer T1 oppose one another, the current through power transistor Q1 causes a flux in the inverter transformer T1 to, in effect, backdrive the tickler coil 110 and cut off the power transistor Q1 base current, thus causing it to turn OFF and forming the relaxation oscillator.

In addition, a secondary coil 120 of the inverter transformer T1 between PAD5 and PAD6 is connected to a pair of diodes D4 and D5 that forms a half-wave rectifier. The pair of diodes D4 and D5 are then serially connected with a Mylar cap 130 and then with a primary coil 140 of the output transformer T2. The primary coil 140 of the output transformer T2 is connected between PAD7 and PAD 8. The Mylar cap 130 is selected to have particular ionization characteristics tailored to a specific spark gap breakover voltage to "tune" the output of the shock circuit.

In operation and as described above, the classic relaxation oscillator produces distorted saw tooth pulses as is shown in FIG. 2. The distorted saw tooth pulses generated by the relaxation oscillator charge the Mylar cap 130, which can be a 0.22 to 0.94 mfd Mylar foil capacitor.

Figure 4:
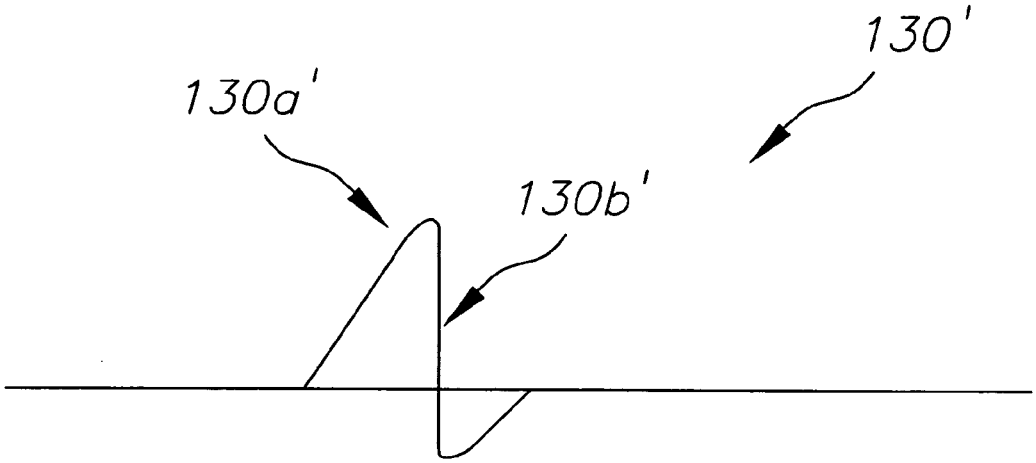
FIG. 4 illustrates a waveform passing through a Mylar gap.
Figure 5:
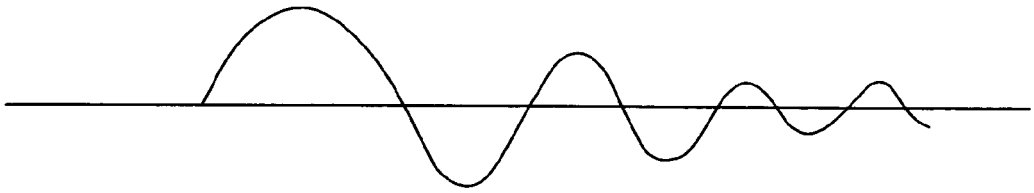
FIG. 5 illustrates an output waveform of a shock circuit using a relaxation oscillator.

Referring also to a waveform 130' of FIG. 4, when sufficient energy is charged on the Mylar cap 130 as schematically represented by the rising part 130*a*' of the waveform 130', a gas gap breaks down as schematically represented by the falling part 130*b*' of the waveform 130'. This energy is then passes through the primary coil 140 of output or step up transformer T2, which typically has a turn ratio of 1:35 to 1:37 primary coil 140 to secondary coil 150. A train of trailing sinusoidal waves are then output by secondary coil 150 of the output transformer T2 as is shown in FIG. 5. This output current of FIG. 5 is essentially a dampened and inverted saw tooth pulse. Its trailing alternating features are the result of "ringing" or tuning in the inverter transformer T1 (the primary or secondary coils 100, 120 inducing steadily declining currents and fields back and forth in each other as the interacting coils magnetic fields repeatedly collapse, regenerate and collapse again). The bulk of the shock energy appears in the first half cycle of the pulses. Though significant energy does appear in the total train of waves trailing thereafter, this tuned energy of the second half cycle is in large measure wasted, as most of the trailing pulses are of insufficient amplitude to cause a debilitating shock.

In addition, since the self actualizing relaxation oscillator includes a bipolar transistor Q1, switching losses may occur. That is, the oscillator fly back or tickler coil 110 is slow to reverse bias the transistor Q1 because of its magnetic feedback. This slow ramping or rise time limits how fast the transistor Q1 can switch without burning up. The slow switching causes power losses. Moreover, because of the slow switching speed, the shock circuit requires larger and bulkier transformers T1, T2, as transformer size is directly proportional to switching speed. As such, the shock circuit of FIG. 3 typically operates at less than 20% efficiency.

Figure 6:
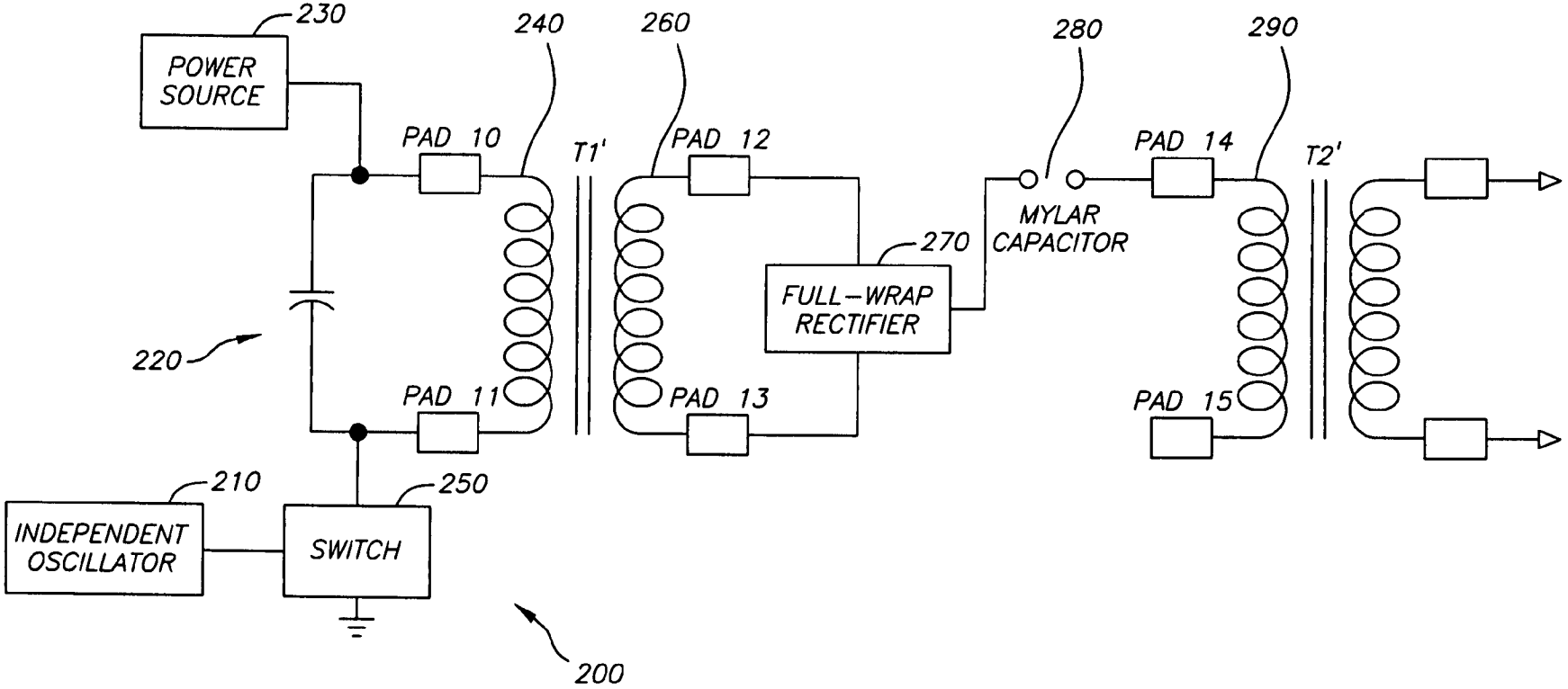
FIG. 6 illustrates an shock circuit using an independently driven oscillator.

In an embodiment of the present invention and referring to FIG. 6, a shock circuit 200 includes an independent, non-self actualizing and/or driven oscillator 210 and a tank circuit 220 that allows the shock circuit 200 to operate with much higher efficiency.

In the shock circuit 200 of FIG. 6, a power is supplied from a battery source 230 to an inverter transformer T1'. In FIG. 6, a primary coil 240 of the inverter transformer T1' is connected between PAD10 and PAD11. In the embodiment, an oscillating capacitor C is also shown to be connected between PAD10 and PAD11 and in parallel with the primary coil 240. As such, the tank circuit 220 of an exemplary embodiment of the present invention is formed by the primary coil 240 of the inverter transformer T1' and the oscillating capacitor C. A power switch 250 is connected between the inverter transformer T1' and a ground. The power switch 250 (or a base or a gate of the power switch 250) is also connected to the independent oscillator 210.

In more detail, the primary coil 240 of the inverter transformer T1' is energized as current flows through the coil 240 from PAD10 to PAD11 as the switch (or transistor) 250 is turned ON. The independent oscillator 210 is coupled to the switch 250 (e.g., at the base or the gate of the switch 250) to turn the switch 2500N and OFF. A secondary coil 260 of the inverter transformer T1' between PAD12 and PAD13 is connected to a full-wave rectifier 270. The full-wave rectifier 270 is then serially connected with a Mylar cap 280 and then with a primary coil 290 of the output transformer T2'. The primary coil 290 of the output transformer T2' is connected between PAD14 and PAD15.

In operation, the capacitor C and the primary coil 240 of the embodiment of FIG. 6 form a second energy saving oscillator. That is, the capacitor C stores energy in the form of an electrostatic field, while the primary coil 240 uses a magnetic field to store energy. As such, any unused energy of the primary coil 240 charges up the capacitor C. The capacitor C then discharges through the primary coil 240. As the capacitor C discharges, the primary coil 240 creates a magnetic field. That is, as the capacitor C discharges, the primary coil 240 will try to keep the current in the circuit moving, so it will charge up the other plate of the capacitor C. Once the field of the primary coil 240 collapses, the capacitor C has been recharged (but with the opposite polarity), so it discharges again through the primary coil 240.

This oscillation will continue until the circuit runs out of energy and will oscillate at an predetermined amplitude and frequency that depends on the size of the primary coil 240 and the capacitor C. As such, the capacitor C can turn the significant energy in the second half of the total train of waves of FIG. 5 that would otherwise be wasted (because of the insufficient amplitude) into additional waves having the sufficient amplitude to cause further debilitating shock. Thus, the efficiency of the shock circuit 200 is enhanced by the capacitor 240 that is in parallel with the primary coil 240 of the transformer T1' thereby forming the tank circuit 220.

Figure 7:
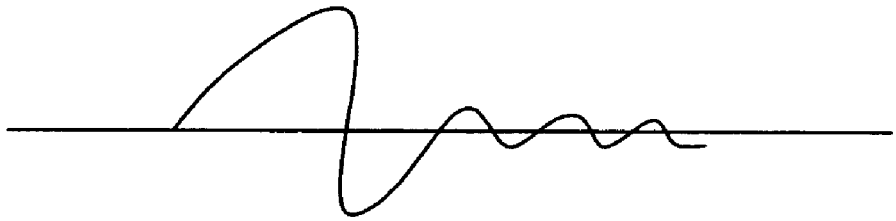
FIG. 7 illustrates a resonate waveform of the shock circuit of FIG. 6.
Figure 8:
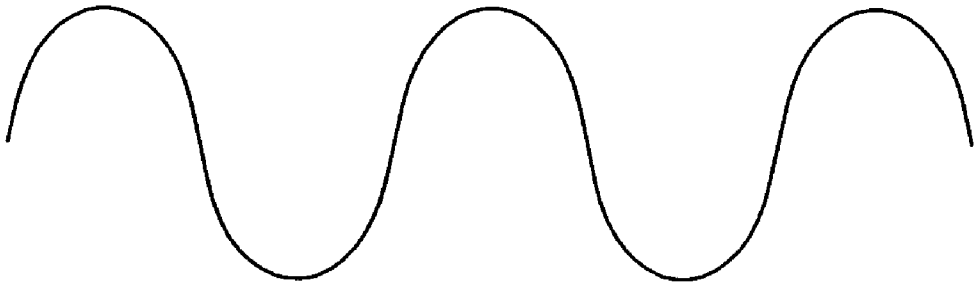
FIG. 8 illustrates an output waveform of the shock circuit of FIG. 6.

In more detail, when the tank circuit 220 is triggered by 250, it begins to resonate. The resonation would thereafter trail off as is shown in FIG. 7. However, switch 250 retriggers the resonant circuit after each full cycle. Accordingly, cycles are continuously produced having a first half cycle and a second half cycle which is near the same in amplitude as the first half cycle, as illustrated in FIG. 8. As such, the energy from the collapsing field of the transformer primary coil 240 is no longer wasted as is in the circuit of FIG. 3, if the full wave rectifier 270 is positioned between the secondary coil 260 of the transformer T1' and the charging Mylar cap 280.

Figure 9:
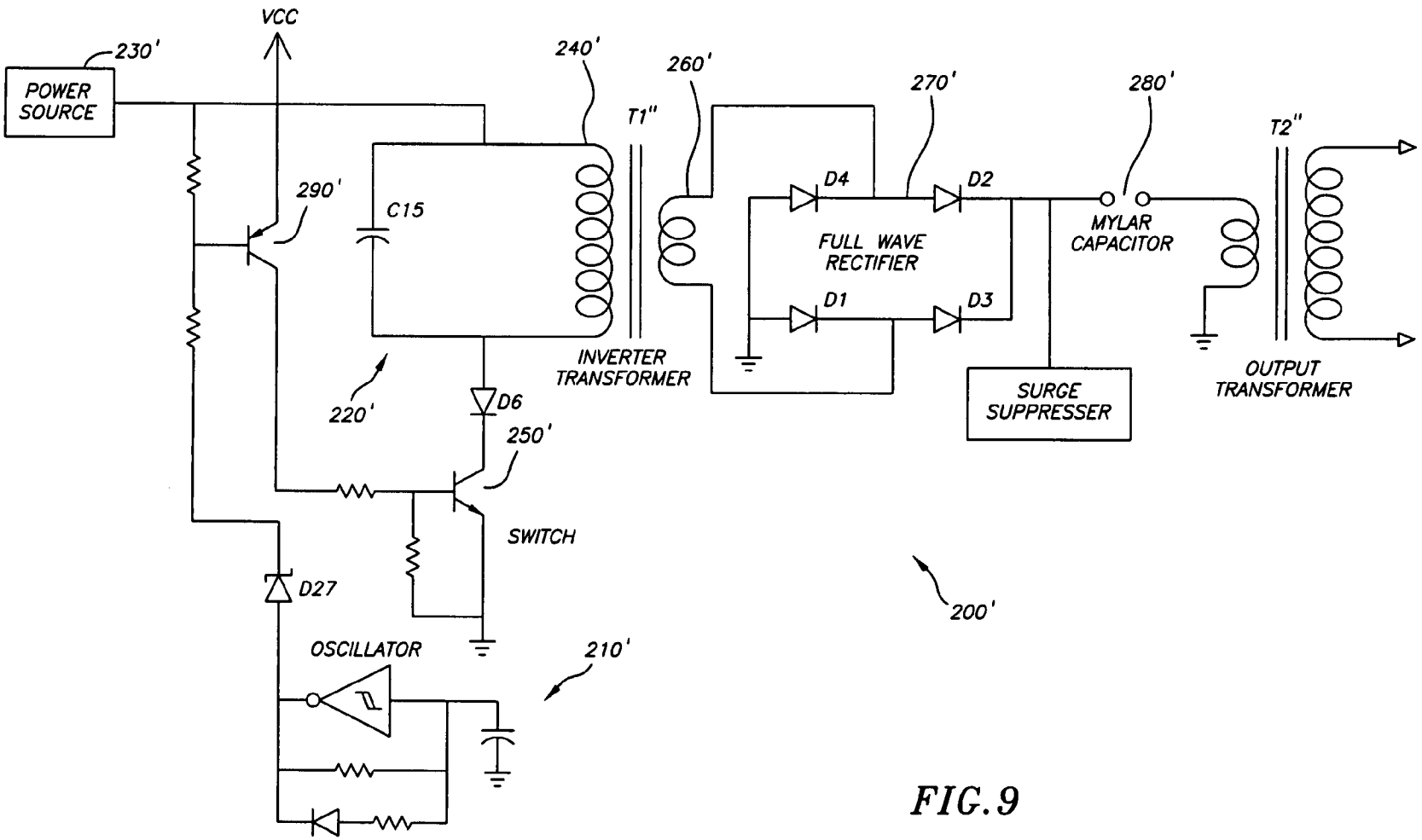
FIG. 9 illustrates another shock circuit using an independently driven oscillator.

Referring to FIG. 9, a shock circuit 200' of a more specific embodiment of the present invention includes an oscillator 210' and a tank circuit 220'. In this shock circuit 200', a power is supplied from a battery source 230' (e.g., a 12V battery) to an inverter transformer T1". The tank circuit 220' in this embodiment is formed by a primary coil 240' of the inverter transformer T1" and an oscillating capacitor C15. An NPN transistor 250' is connected between the inverter transformer T1" and a ground. A base of the NPN transistor 250' is connected to the oscillator 210'. A secondary coil 260' of the inverter transformer T1" is connected to a first pair of diodes D4 and D2 and a second pair of diodes D1 and D3. The first and second pairs of diodes D1, D2, D3, and D4 form a full-wave rectifier 270'. The full-wave rectifier 270' is then serially connected with a Mylar cap 280' and then an output transformer T2".

In operation, the oscillator 210' creates a periodic output that varies from a positive voltage (V+) to a ground voltage. This periodic waveform creates the drive function for the PNP transistor 290'. The output voltage of the oscillator 210' is not a square wave but a pulse waveform that is low for about one third of its period. When the oscillator 210 switches low, it causes zener diode D27 to conduct, and in turn, causes the transistor 290' to saturate. The zener diode D27 is needed because the voltage Vcc, that powers the transistor 290' and the positive voltage (V+) that powers the oscillator 210' are at different potentials. When 290' turns on, it in turn causes the transistor 250' to saturate. This, in turn causes current to flow through the primary coil 240' of the transformer T1". This current flow causes current to flow in the secondary coil 260' of the transformer T1" based on the turn ratio of the transformer T1". In this particular situation, the transformer T1" has a turn ratio of about 110:1 (or 110 to 1). A power current from the battery source 230' then flows in the primary coil 240' of the transformer T1" only when the transistor 250" is turned on and is in the process of conducting. Residual current, however, can also be flown through the primary coil 240' as the magnetic field, initially generated by the current flow from the battery source 230', collapses and the tank circuit 220' mechanized with the primary coil 240"of the transformer T1" and capacitor C15 begins to resonate. This "resonant current" is also coupled through the transformer T1" from the primary coil 240' to the secondary coil 260' and, in turn, also is stepped up by the turn ratio of the transformer T1".

The full wave bridge rectifier 270', mechanized with the four high voltage diodes D1, D2, D3, and D4, therefore rectifies the initial voltage and current from the power source 230' when the transistor 250' is caused to conduct, and then the resonant voltage and current created as the tank circuit 220' resonates. The effect of this is to cause the Mylar cap 280' to charge more quickly and with more efficiency, thereby requiring less energy drawn from the power source 230' than if the tank circuit 220' was not present in the design.

An additional feature of this shock circuit 200' is that the transistor 250' is a high voltage transistor with a Vcc of greater then 1000 volts. This eliminates the need for a "snubber" diode across the transformer primary. A diode D6 is required, however, because as the tank circuit 220' resonates, it would have the capability to break down the transistor 250' over in the reverse direction thereby potentially damaging the transistor 250' and "snubbing" the tank circuit 220' resonance prematurely.

Figure 10:
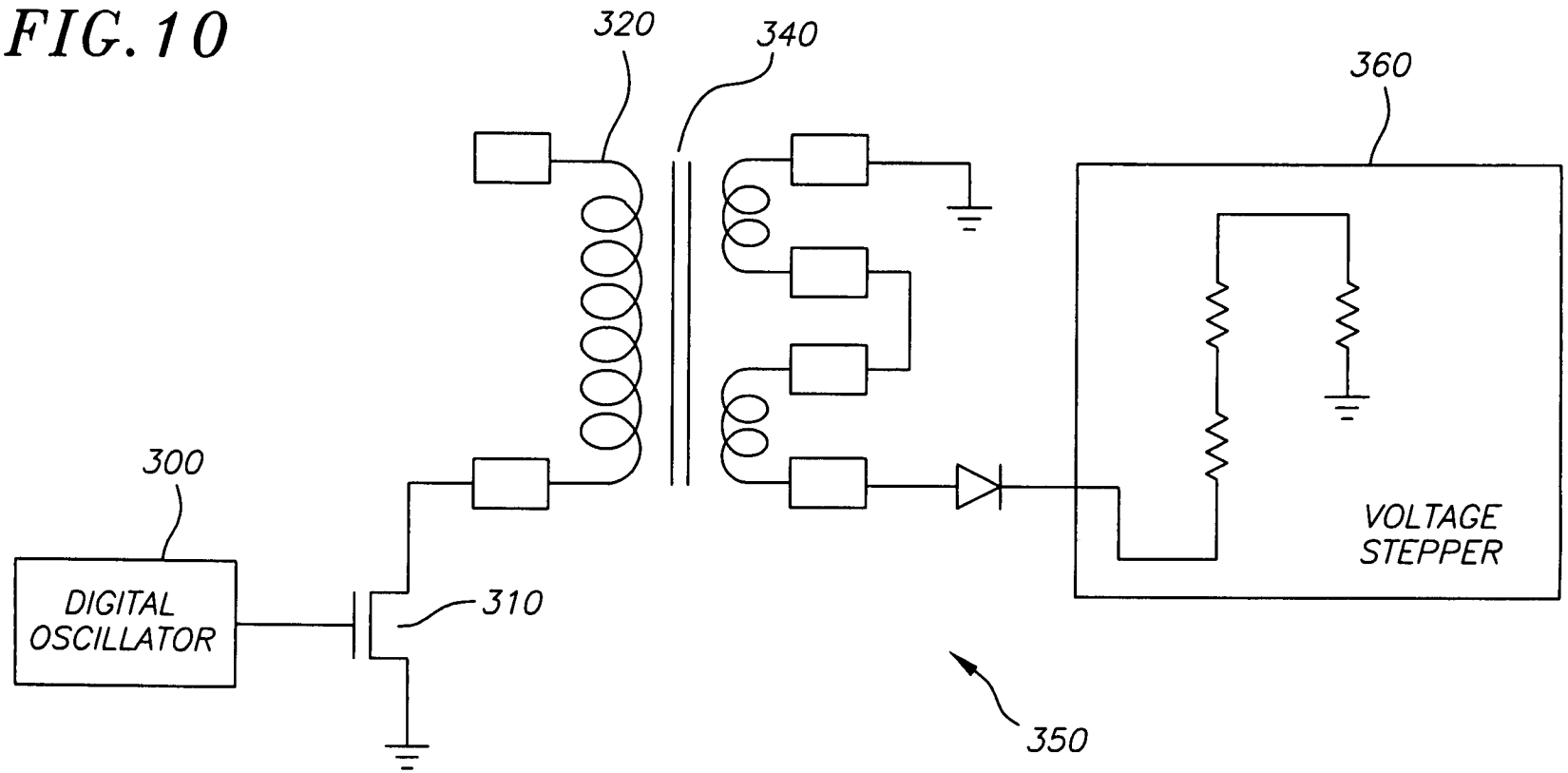
FIG. 10 illustrates yet another shock circuit using an independently driven oscillator.

In a generalized exemplary embodiment of the present invention, a portion of a shock circuit that is employed to generate a high voltage used to deliver a current pulse to an output transformer utilizes a resonant tank circuit. The tank circuit assists in the creation of the high voltage level necessary to charge the Mylar cap through the fact that it resonates at a frequency determined by the inductance of the primary coil of an inverter transformer and the capacitor that is placed in parallel with it. However, the present invention is not limited to the above described exemplary embodiment. For example, referring to FIG. 10, an embodiment of a shock circuit 350 can include a digital oscillator 300 coupled to digitally generate switching signals to a base or a gate of a transistor 310. The transistor 310 is coupled in series with the primary coil 320 of a transformer 340 to alternately conduct from collector to emitter or source to drain of the transistor 310. The transformer 340 is coupled to an voltage stepper 360 (e.g., an autoformer) to step-up the voltage of the signal generated by the transformer 340. In this embodiment, no third tickler coil is present as is shown in FIG. 3. The digitally generated signal drives the switching transistor 310 and transformer 340. The driven transformer 340 allows for greater frequency operations control. If a MOSFET transistor is used as the transistor 310, there is a reduction in power loss from the switching, and the transistor 310 can switch at faster speeds.

In view of the foregoing, certain high efficiency circuits can be employed to form electrical discharge weapons with higher energy shocks with similar sizes to weapons with circuits having self actualizing relaxation oscillators. However, the propriety of forming weapons capable of producing such high powered shocks may be in question because the enhanced shocks may increase the weapons lethality, especially where circuits operating at a fraction of the power ranges that can be achieved by these circuits (e.g., at power levels as low as 1.5 watts and 0.15 joules per pulse at ten pps) were demonstrated to completely disable test subjects as early as 1971. In addition, some seventy deaths have occurred proximate to use of such weapons. As such, using these weapons at high power ranges may run contrary to the idea that electrical discharge weapons are intended to subdue and capture live targets without seriously injuring them. Therefore, a more laudable purpose for such high efficiency circuits would be to reduce the weights of shock circuits at the lower and safer power levels, so that the circuits can be entirely contained in projectiles and to eliminate the need for range limiting trailing wires.

Less lethal wireless projectiles could not, heretofore, be launched to optimally desired tactical ranges while maintaining safe force factors, because, as currently produced by various manufacturers, the shock circuits that might be contained within the projectile have too great a weight.

The primary consideration when assessing the relative lethality of a non-lethal projectile is the kinetic energy that is transferred to the target upon impact. The energy is equal to one-half the mass of the projectile times the square of the velocity:

$$K.E.=\tfrac{1}{2}mv^2$$

This equation shows the strong dependence on velocity and a lesser dependence on the mass of the projectile. It is desirable to keep the velocity high to deliver the maximum kinetic energy, within the constants of non-lethal impact to the body (blunt impact trauma and penetration). Higher velocities also have the desirable effect of maximizing the accuracy and flight stability of the projectile, for improved flight characteristics and trajectory.

Much research has been done to characterize the blunt trauma and penetration characteristics of non-lethal projectiles, and these results have been correlated with specific ranges of kinetic energy and kinetic energy per unit of impact area. Acceptable impact properties can usually be achieved by controlling the kinetic energy delivered to the target, maximizing the impact area that contacts the target, or by designing features into the projectile that absorb or dissipate energy upon impact.

When trying to find a compromise between the competing goals of maximum kinetic energy, optimum flight characteristics, and non-lethal impact properties, the designer is usually faced with sacrificing performance in one area to satisfy requirements in another when adjusting the velocity. One way to control the kinetic energy while keeping the velocity as high as possible for optimum flight considerations is to decrease the mass of the projectile. While this has a smaller effect on the kinetic energy than the velocity, it allows the designer some flexibility to decrease the impact energy without affecting performance.

In one embodiment of the present invention, a shock circuit includes a non-self actualizing oscillator. The shock circuit can be less than or equal to forty-five grams, produce a shock power that is less than nine watts, and/or produce each pulse at an energy range that is less than 0.9 joules. In one embodiment, each pulse is produced at an energy range that is not less than 0.15 joules and not greater than 0.75 joules.

In more detail, the profile of pulses used in an exemplary embodiment should be within the following ranges. First, the energy produced by the pulses should be in the range of about 0.01 to 0.8 joules or about 0.5 to 0.75 joules. Second, the width of each pulse should be about one to nine microseconds or about seven and a half to nine microseconds. Third, the root-mean-square (rms) current of the pulses should be in the range of about twenty to ninety milliamps or about sixty-five to ninety milliamps. In addition, the pulses should be delivered to a target having a travel spacing (or distance) within the target to induce enough skeletal muscles contractions such that the live target subjected to the pulses is actually disabled.

Figure 11:
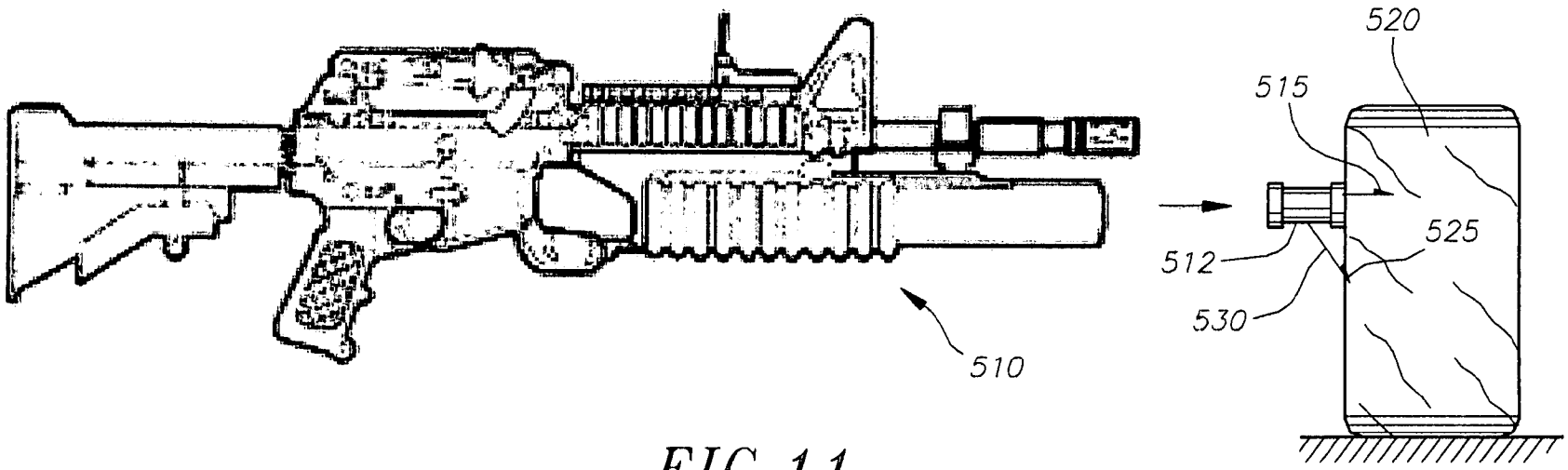
FIG. 11 illustrates an electrical discharge weapon system projecting a wireless projectile.

Referring to FIG. 11, an exemplary shock circuit of the present invention is integrated into an exemplary projectile 512 to allow the above profiled pulses to be delivered into a target 520 with the required travel spacing within the target 520. As is shown, a grenade launcher 510 (e.g., an M203, an M79, etc.) is used to propel the projectile 512 to impact the target 520. The impact of the target 529 has caused connectors 515 and 525 to contact and affix to the surface of the target 520. The distance between the grenade launcher 510 and the projectile 512 can vary (typically about six to fifty meters or twenty to one hundred fifty feet). As is shown in FIG. 11, there are no wires extending from the grenade launcher 510 to the projectile 512 because the shock circuit is entirely contained in the projectile 512. In addition, a wire tether 530 is shown to be attached to connector 525 for providing a selected separating distance between the two connectors 515 and 525.

Figure 12:
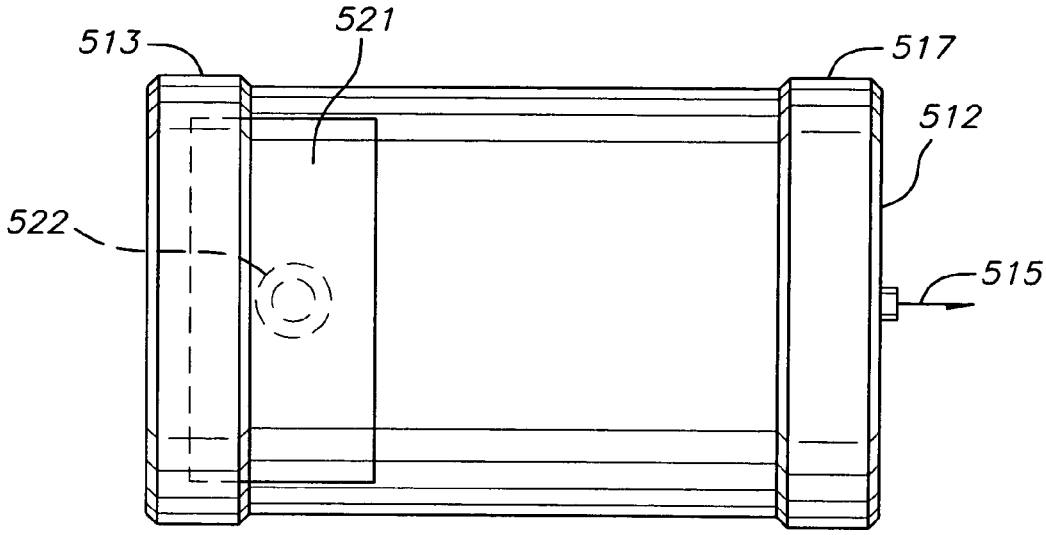
FIG. 12 illustrates a top view of the projectile of FIG. 11
Figure 13:
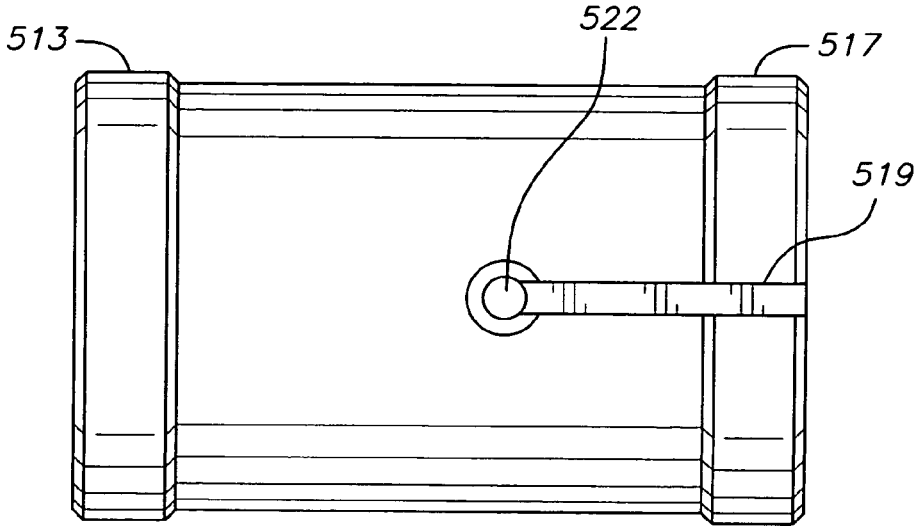
FIG. 13 illustrates a bottom view of the projectile of FIG. 11
Figure 14:
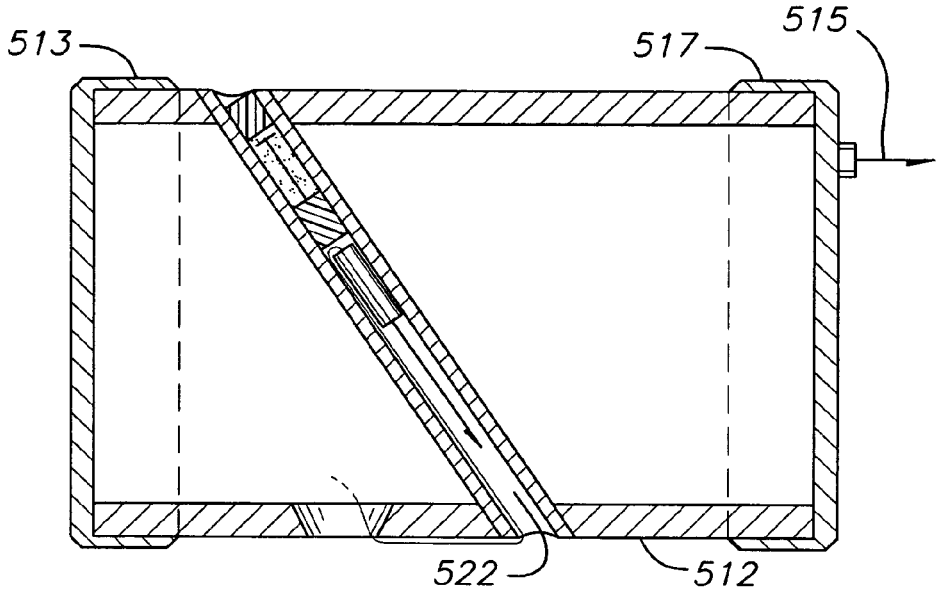
FIG. 14 illustrates a cutaway side view of the projectile of FIG. 11

In more detail and referring to FIGS. 12–15, the projectile 512 is configured as a generally hollow cylinder having end caps 513 and 517, the latter having the connector 515 extending longitudinally therefrom. A projectile of present invention, however, is not limited to a cylindrical shape projectile and can be any shape known to these skilled in the art (e.g., a sphere, a cube, etc.). As is shown, a diagonal passage 522 extends into the projectile 512 through the center of the projectile 512 to form an opening in the radial surface of the projectile 512 as is shown in FIGS. 12 and 13.

Figure 15:
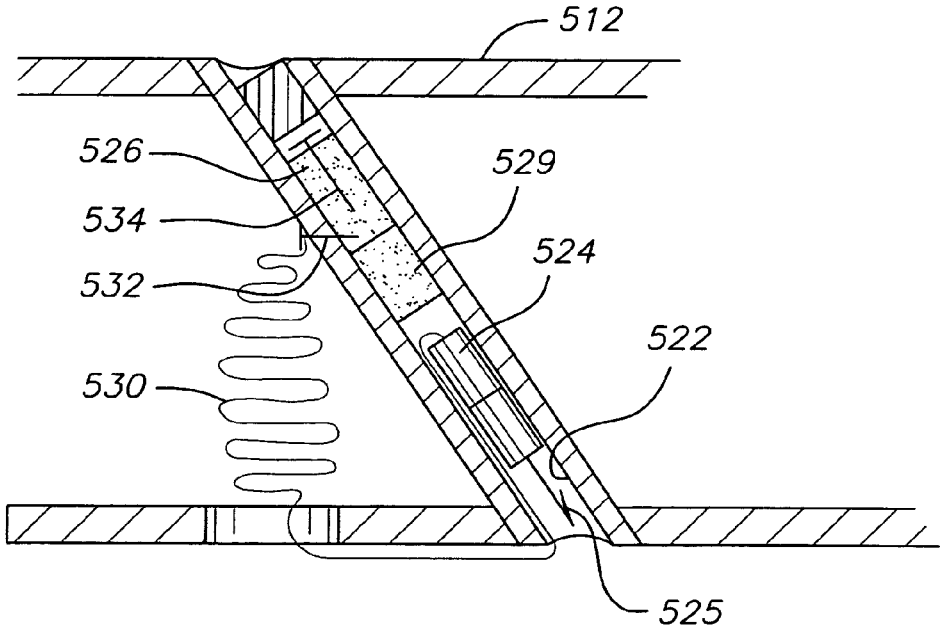
FIG. 15 illustrates a cross-sectional view of a secondary propulsion device of the projectile of FIG. 11.

A passage 522 is covered with a Mylar tape 521 where it opens adjacent end cap 513. The tape 521 protects a primer 528 shown in FIG. 15. As is also shown in FIG. 15, within the passage 522 there are positioned a styrofoam 526, a foam wad 529, and a connector body 524 terminating in the connector 525, the point of which resides near the opening of the passage 522 closer to the end cap 517. A metal foil contact 519 projects from that opening to and over the end cap 517 terminating adjacent the front end of the projectile 512. Also positioned within the passage 522 are pins 532 and 534. The first pin 534 is positioned between the primer 528 and the styrofoam 526 and extends through the styrofoam toward the pin 532. The second pin 532 is connected to the wire tether 530 and which is, in turn, connected to the axial end of the connector body 524.

Figure 16:
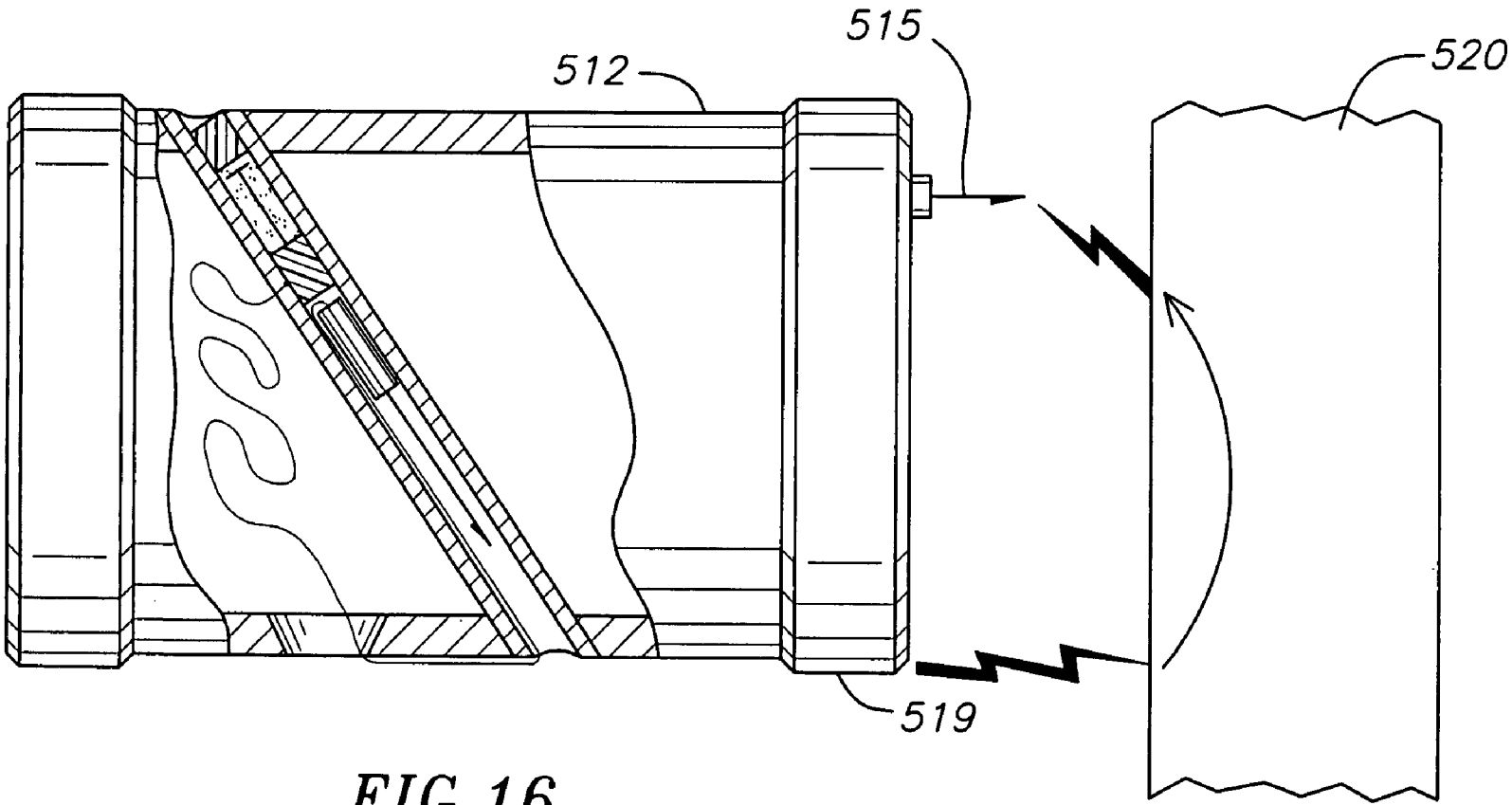
FIGS. 16 and 17 illustrate in sequence a terminal operation of the projectile of FIG. 11.
Figure 17:
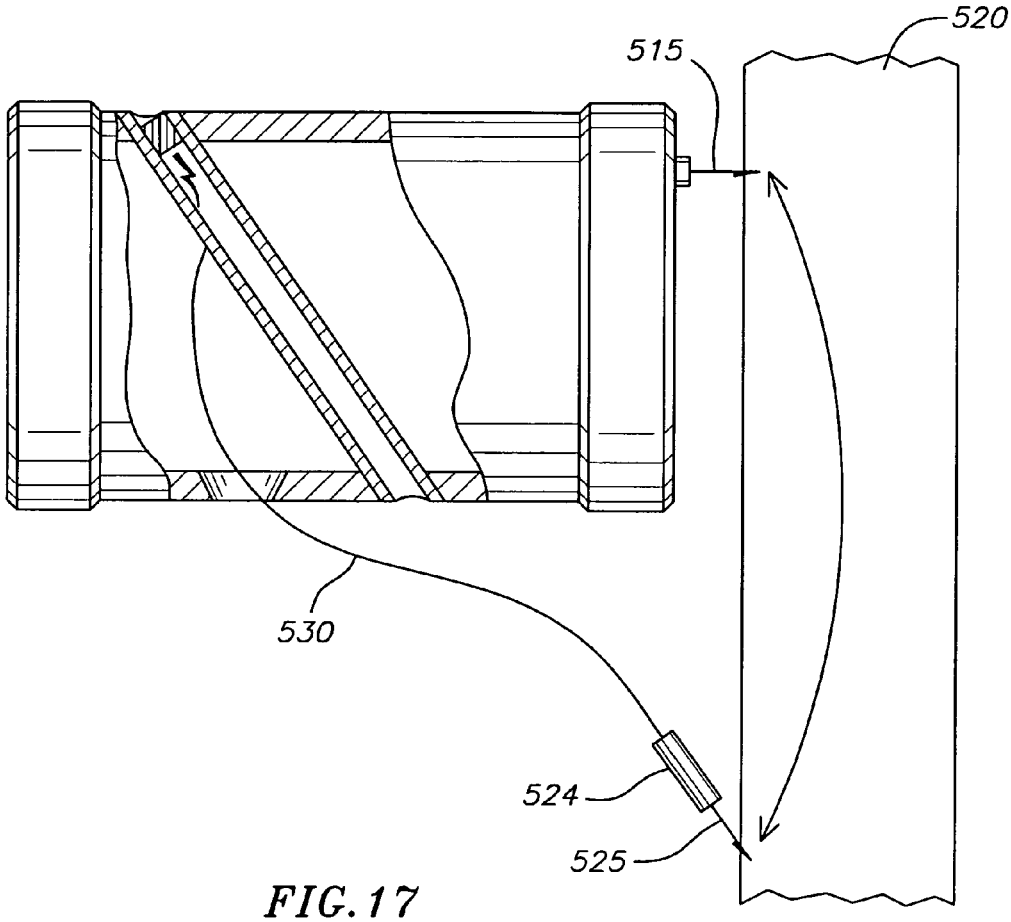

The terminal operation of the projectile 512 as it nears and engages the target 520, is illustrated sequentially in FIGS. 16 and 17. As shown in FIG. 16, when the projectile 512 and the connector 515 are near the target 520 (actual distance depends upon electrical parameters and ambient conditions), arcing occurs through the target between the connector 515 and the foil 519. The resulting current flow back into the projectile 512 and including the metal wall of the passage 522, ignites the primer 528 and propels the connector body 524 through the passage 522 and on a generally diagonal path toward the target 520 until the connector 525 contacts and affixes to the target surface at a location spaced from the point that the connector 515 also contacts and affixes to the target surface. Connector 525 may be launched from passage 522 to target 520 on or after impact with target 520 by other means.

This secondary propelling of the second connector 525 only when the projectile 512 is close to or in contact with the target 520 assures that, irrespective of the distance to the target 520, the spacing between connectors 515 and 525 will be substantially the same. Moreover, the spacing will be within a range to virtually assure optimal disabling effect on the target.

In one embodiment, the wire tether 530 can be about forty-six cm or eighteen inches long and the passage 522 can be at an angle greater than forty-five degrees, or about seventy degrees with respect to the axis of the projectile 512.

An embodiment of the projectile 512 can be configured as a fixed ammunition shell which can be fired through a conventional thirty-eight mm or forty mm bore or which can be between 38 to 40 mm in caliber. An embodiment of the projectile 512 can also be launched by gas expansion in the launching cartridge or casing in the chamber of a firearm. In one embodiment, the projectile 512 should be less than 110 grams and should produce a force of less than about twelve newtons or ninety $ft \cdot lb/s^2$ (pdl) on the target 520. The shock circuit integrated into the projectile 512 should not be greater than 45 grams or about 25 grams and should produce a shock power that is less than nine watts or between about two to six watts. Otherwise, the operation of the projectile 512 should act like a standard shell when it is desired to immobilize a target.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electrical shock circuit for an electrical discharge weapon comprising:

a battery source;

an inverter transformer having a primary coil of the inverter transformer connected between a first pad and a second pad and a secondary coil of the inverter transformer connected between a third pad and a fourth pad;

an oscillation capacitor connected between the first pad and the second pad;

an independent oscillator;

a switch connected between the inverter transformer and a common voltage node, the switch being also connected to the independent oscillator; and a full wave rectifier connected with the secondary coil of the inverter transformer via the third pad and the fourth pad, wherein the independent oscillator triggers the switch to supply an energy from the battery source to the primary coil of the inverter transformer, wherein the primary coil of the inverter transformer oscillates the energy with the oscillation capacitor at a resonate frequency for a full cycle of the energy, wherein the full cycle of the energy has first and second half cycles, and wherein the first and second half cycles have substantially the same amplitude.

2. The electrical shock circuit of claim 1, wherein the independent oscillator re-triggers the switch to supply another energy from the battery source to the primary coil of the inverter transformer.

3. The electrical shock circuit of claim 2, wherein the primary coil of the inverter transformer oscillates the another energy with the capacitor at a resonate frequency for a full cycle of the another energy, wherein the full cycle of the another energy has first and second half cycles, and wherein the first and second half cycles of the another energy have substantially the same amplitude.

4. The electrical shock circuit of claim 1, wherein the independent oscillator re-triggers the switch to supply another energy for a predetermined time period.

5. The electrical shock circuit of claim 1, further comprising:

an output transformer having a primary coil of the output transformer and a secondary coil of the output transformer;

a spark gap coupled between the secondary coil of the inverter transformer and the primary coil of the output transformer; and a pair of conducting connectors having a predetermined gap therebetween coupled to the secondary coil of the output transformer.

6. The electrical shock circuit of claim 5, wherein the full wave rectifier comprises first, second, third, and fourth diodes, wherein the third pad is coupled between the first and second diodes, wherein the fourth pad is coupled between the third and fourth diodes, and wherein the first, second, third, and fourth diodes are coupled between a ground and the spark gap.

7. The electrical shock circuit of claim 5, wherein the spark gap comprises a Mylar cap.

8. The electrical shock circuit of claim 1, wherein a diode is coupled between the inverter transformer and the switch.

9. The electrical shock circuit of claim 1, wherein the switch comprises a bipolar type transistor having a base coupled to the independent oscillator.

10. The electrical shock circuit of claim 1, wherein the switch comprises an N-type transistor.

11. The electrical shock circuit of claim 10, further comprising a P-type transistor coupled between the independent oscillator and the N-type transistor.

12. The electrical shock circuit of claim 11, further comprising a zener diode coupled between the independent oscillator and the P-type transistor.

13. The electrical shock circuit of claim 1, wherein the independent oscillator generates a pulse waveform to trigger the switch.

14. The electrical shock circuit of claim 13, wherein the pulse waveform is at a low level for about one-third of a period of the pulse waveform.

15. A method of immobilizing a live target through electricity, the method comprising:

oscillating an independently controlled waveform from a positive voltage to a ground voltage;

driving a transistor via the independently controlled waveform to turn ON and OFF;

energizing an initial energy from a battery source through a primary coil of an inverter transformer only when the transistor is turned ON by the independently controlled waveform;

resonating a residual energy with a capacitor connected in parallel with the primary coil of the inverter transformer as a magnetic field initially generated by the initial energy flow from the power source collapses;

coupling the initial energy and the resonated residual energy from the primary coil of the inverter transformer to a secondary coil of the inverter transformer; and rectifying an initial voltage and current of the initial energy and then a resonant voltage and current of the resonated residual energy in a full-wave manner.

16. The method of claim 15, wherein the independently controlled waveform is at the ground for about one-third of a period of the waveform.

17. The method of claim 15, wherein the initial energy and the resonated residual energy in a full cycle have substantially the same voltage amplitude.

18. The method of claim 17, further comprising:

energizing another energy from the battery source through the primary coil of the inverter transformer as the full cycle collapses.

19. An electrical shock circuit for an electrical discharge weapon comprising:

means for oscillating an independently controlled waveform from a positive voltage to a ground voltage;

means for driving a transistor via the independently controlled waveform to turn ON and OFF;

means for energizing an initial energy from a battery source through a primary coil of an inverter transformer only when the transistor is turned ON by the independently controlled waveform;

means for resonating a residual energy with a capacitor connected in parallel with the primary coil of the inverter transformer as a magnetic field initially generated by the initial energy flow from the power source collapses;

means for coupling the initial energy and the resonated residual energy from the primary coil of the inverter transformer to a secondary coil of the inverter transformer; and means for rectifying an initial voltage and current of the initial energy and then a resonant voltage and current of the resonated residual energy in a full-wave manner.

20. The electrical shock circuit of claim 19, further comprising:

means for stepping-up a voltage coupled to the means for rectifying.

21. The electrical shock circuit of claim 19, further comprising:

an output transformer having a primary coil of the output transformer and a secondary coil of the output transformer;

a spark gap coupled between the secondary coil of the inverter transformer and the primary coil of the output transformer; and a pair of conducting connectors having a predetermined gap therebetween coupled to the secondary coil of the output transformer.

22. The electrical shock circuit of claim 1, wherein the electrical shock circuit is contained within a launchable projectile of the electrical discharge weapon.

* * * * *